US005480090A

United States Patent [19]

Taddei et al.

[11] Patent Number: 5,480,090

[45] Date of Patent: Jan. 2, 1996

[54] WRAPPING AS PACKAGING

[75] Inventors: Renzo Taddei, Viganello; Franco Roda, Pregassona, both of Switzerland

[73] Assignee: Fratelli Roda S.A., Taverne, Switzerland

[21] Appl. No.: 286,909

[22] Filed: Aug. 8, 1994

[30] Foreign Application Priority Data

Aug. 10, 1993 [CH] Switzerland ..... 2385/93

[51] Int. Cl.[6] ..... B65D 5/42

[52] U.S. Cl. ..... 229/162; 206/806; 229/114; 229/160

[58] Field of Search ..... 229/113, 114, 229/160, 162, 169, 171; 206/45.31, 806

[56] References Cited

U.S. PATENT DOCUMENTS

| | | | |
|---|---|---|---|
| 2,996,236 | 8/1961 | Barr | 229/162 |
| 3,253,769 | 5/1966 | Opler | 229/162 |
| 3,572,576 | 3/1971 | Foster | 229/160 |
| 3,933,303 | 1/1976 | Kirby, Jr. | 229/117.13 |
| 4,300,716 | 11/1981 | Jennings | 229/160 |
| 4,457,431 | 7/1984 | Lundquist et al. | 229/162 |
| 5,193,671 | 3/1993 | Patterson | 229/120.37 |
| 5,249,738 | 10/1993 | Werth | 229/235 |

FOREIGN PATENT DOCUMENTS

| | | | |
|---|---|---|---|
| 5124635 | 5/1993 | Japan | 229/160 |
| 608633 | 9/1948 | United Kingdom | 229/162 |

OTHER PUBLICATIONS

The Wiley Encyclopedia of Packaging Technology, John Wiley & Sons, pp. 565–568 (1986).

*Primary Examiner*—Gary E. Elkins
*Attorney, Agent, or Firm*—Young & Thompson

[57] ABSTRACT

A wrapping to be used as packaging (6) has a flat backing part (1A) and another shaped flat part (1B). A window (4) can be made in the flat backing part (1A). These two parts (1A, 1B) are formed from a single piece which has been punched out and folded from a flat sheet (1) of packaging material. The use of cardboard is preferred since it is possible to use recycled paper material without detracting from the aesthetic appearance of the package.

4 Claims, 5 Drawing Sheets

WRAPPING AS PACKAGING

BACKGROUND OF THE INVENTION

1. Field of the Invention

The invention relates to the field of packaging, in particular a wrapping for packaging which is called "blister" pack in specialist's jargon and which usually enables the product contained therein to be seen through an opening or window, and consequently displayed in stores.

2. Description of the Related Art

In the current state of the art, this type of wrapping, with or without this window, is produced by using glue or a similar system to join a first flat blank part in which this window can be made if necessary, and a second part shaped so as to hold the product.

In most cases the flat part is made of cardboard and the second part of plastic, transparent or not quite transparent.

This type of wrapping as packaging entails many problems and disadvantages, such as for example the complicated dimensions of the parts comprising the wrapping which must be transported, the necessity of having to dispose of the two parts of the wrapping in different ways since they are made of different materials, and the necessity in most cases of having to imprint each part in two separate operations in order to apply graphics such as the company logo, instructions, or other information.

Moreover, in some types of wrapping produced more recently, in which cardboard is used as a material for both of these parts, all the problems described above remain, with the exception of the difficulty in disposal.

SUMMARY OF THE INVENTION

The inventor has provided a comprehensive solution to all these problems by creation of wrapping as packaging made in a single piece.

In particular, the object of this invention is wrapping as packaging of the type described above, which has the characteristics defined in the specification.

BRIEF DESCRIPTION OF THE DRAWINGS

A more detailed description of the invention follows, with reference to the attached figures, which represent.

DETAILED DESCRIPTION OF THE PREFERRED EMBODIMENTS

The idea on which the invention is based is simple and logical: make wrapping as packaging by punching out a flat sheet of packaging material in such a way as to form, by subsequent refolding along the premade fold lines, a shaped container which is then closed by gluing its facing edges together.

Figure 1:
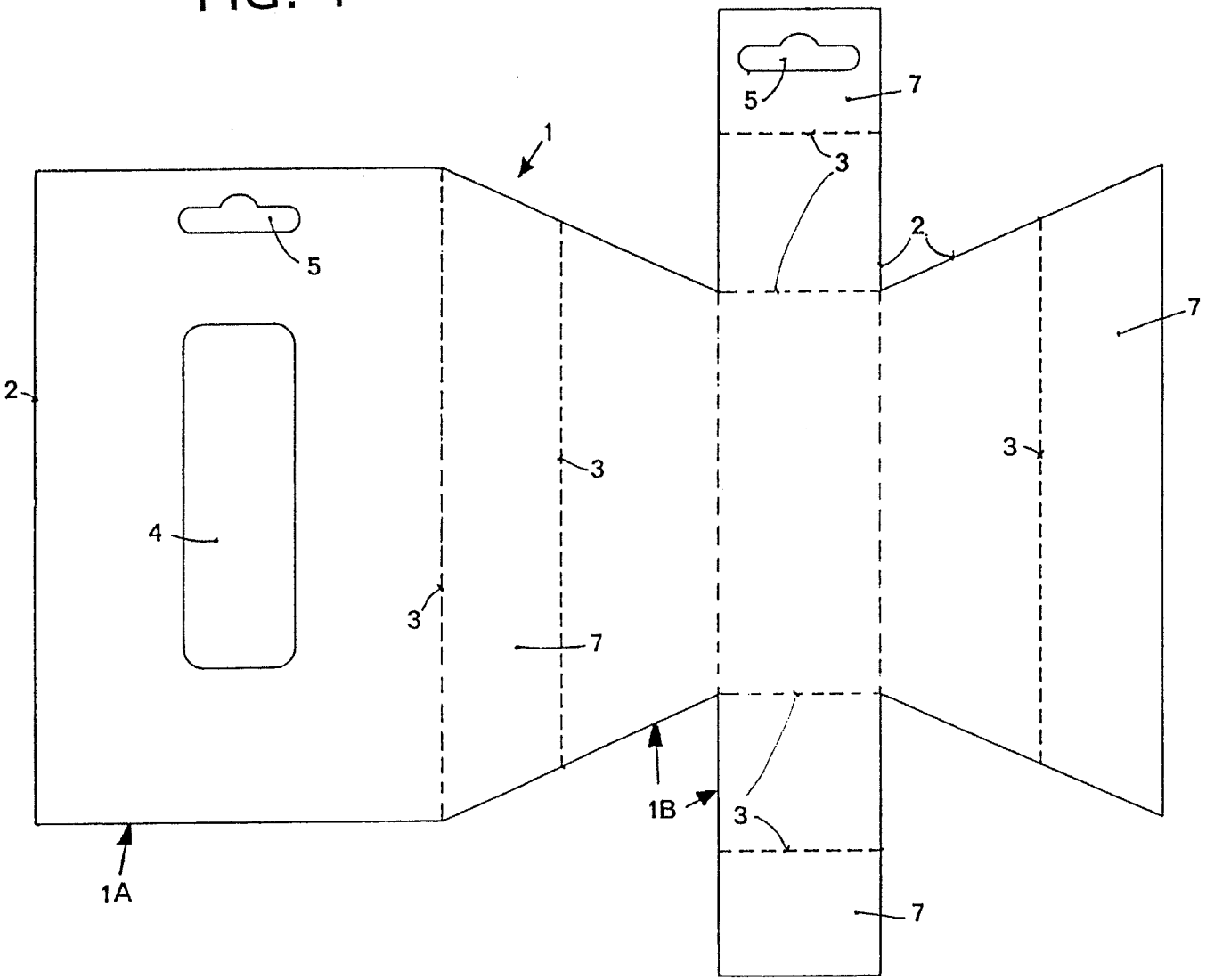
in FIG. 1 a plan view of the flat blank, a first embodiment of the wrapping according to the invention.
Figure 2:
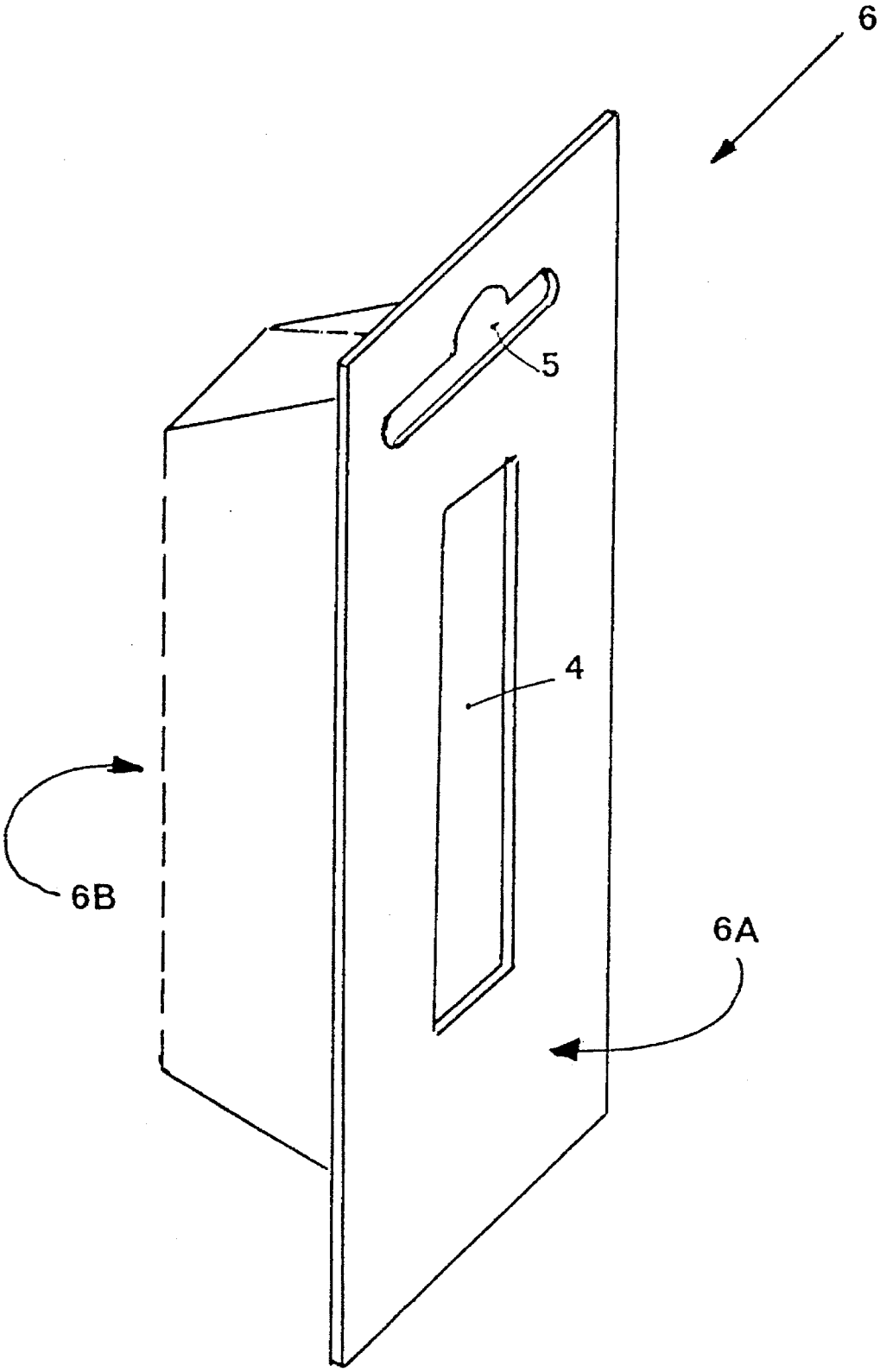
in FIG. 2 a perspective view of this wrapping in FIG. 1 after it has been shaped in an appropriate manner by folding and gluing.
Figure 3:
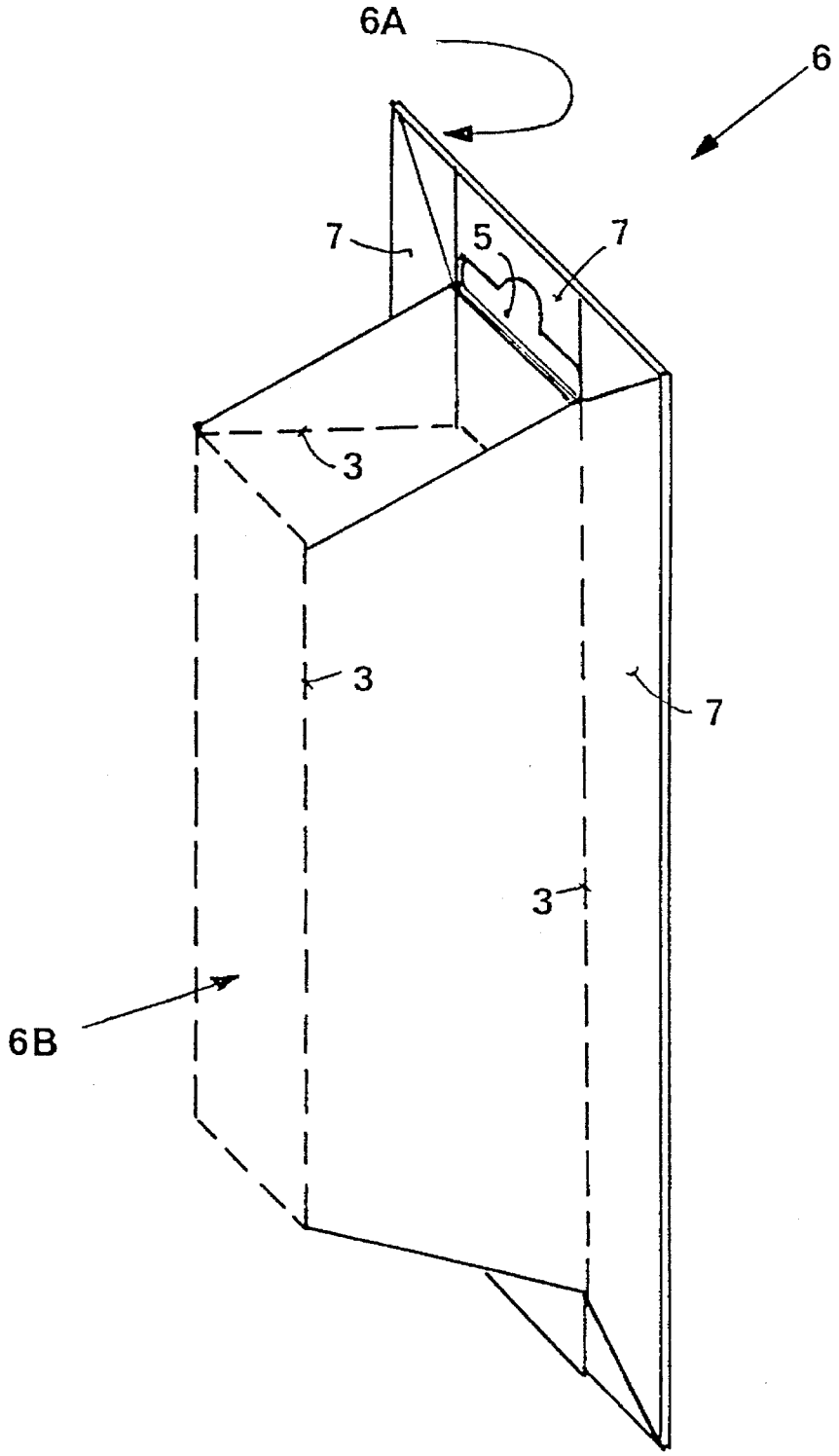
in FIG. 3 a perspective view of the wrapping shown in FIGS. 1 and 2 from another point of view.

Examination of FIGS. 1, 2 and 3 reveals the following, to this extent: a flat sheet 1 of packaging material is punched out along continuous outlines 2, and on it are punched out premade fold areas shown with dashed fold lines 3.

By properly refolding the flat sheet so as to cover with flat backing part 1A another flat part 1B of the wrapping, which is then folded along the premade fold lines 3, wrapping as packaging 6 (FIGS. 2 and 3) is obtained with the desired shape.

In this first punchout operation, window 4 can also be made for display of the product, and on two facing parts buttonhole 5 can be made for hanging the package in the store. The area intended for gluing is surface 7.

The advantages of this type of wrapping as packaging according to the invention are clear: first of all, only one piece is worked using a single punching operation, and secondly, only one printing operation is used on one side of the flat blank face of the wrapping; the desired graphics can be produced either on doverse face 6A or reverse side 6B of the packaging 6.

Likewise, a strip of glue, lacquer or other adhesive can be applied in a single operation on only one of the two faces of the flat blank.

The wrapping as packaging according to the invention can also be prepared for transporting before folding and gluing, the dimensions during this phase being only minimal due to the fact that these wrappings, which are only flat blanks composed of thin sheets of packaging material, will be in a stack, one on top of the other. In a preferred embodiment of the invention, this material is cardboard, which is recyclable.

Since, as already indicated, only one of the faces of the flat blank of the wrapping forms both faces 6A and sides 6B in the finished wrapping, the use of recycled cardboard, which as is recognized has one side that is not especially attractive, is not precluded.

Once the wrapping is finished, in fact, only the attractive side will be visible from the outside.

Figure 4:
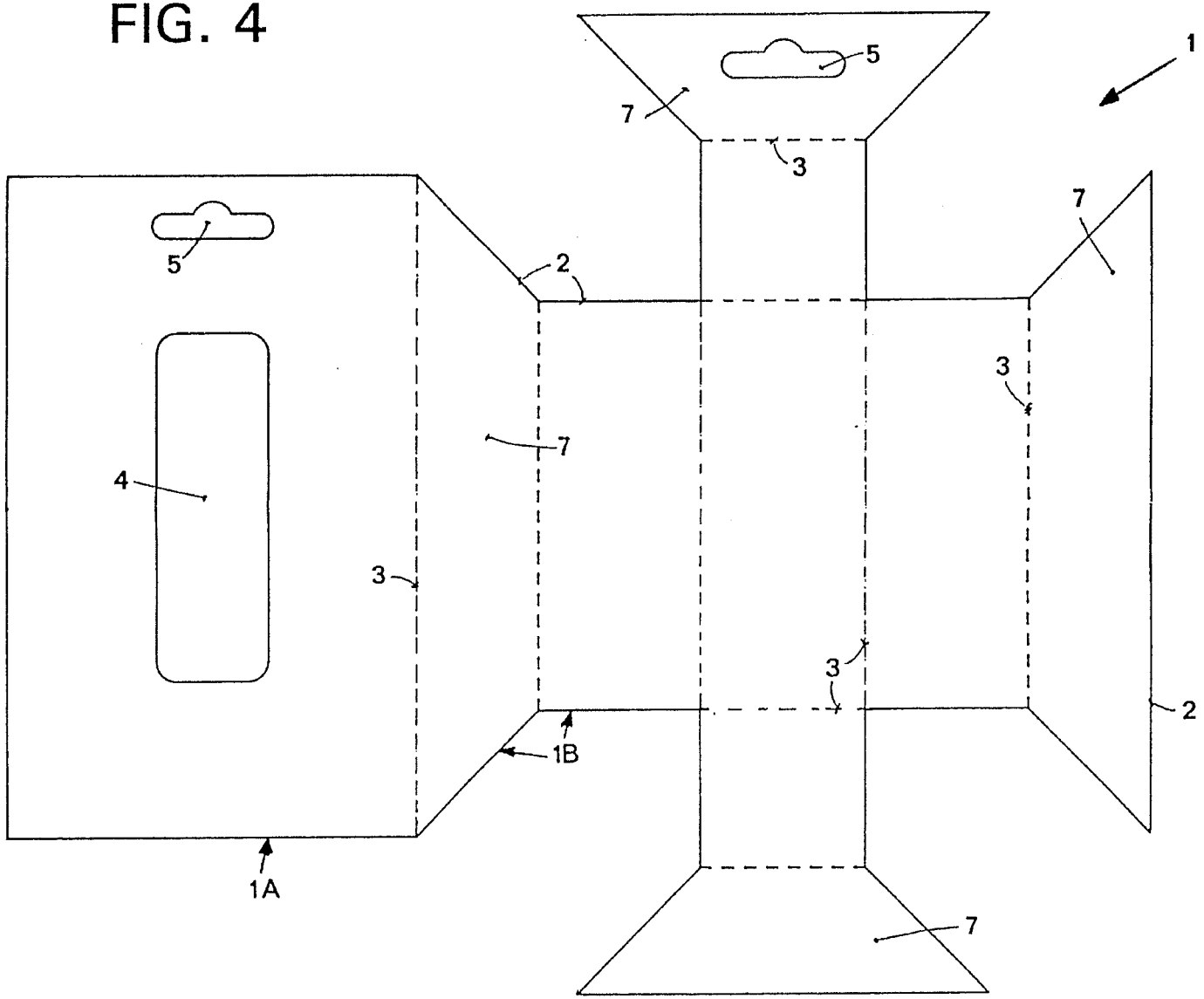
in FIG. 4 a plan view of another embodiment of the invention; and in FIG. 5 a plan view of a last embodiment of the invention.
Figure 5:
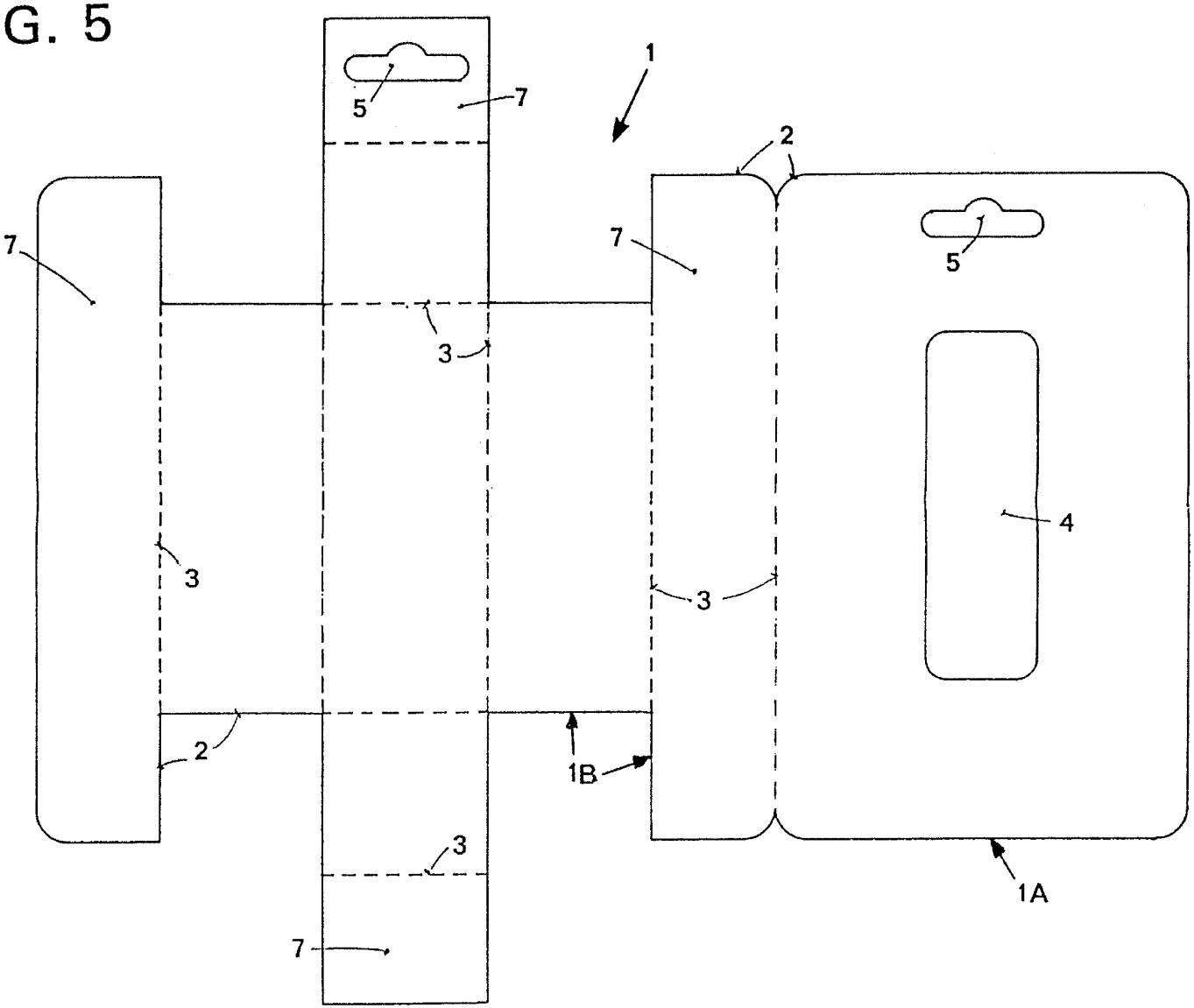

For this purpose all that must be done is to cut a blank of the flat sheet of recycled cardboard in such a way that the flat backing part 1A will in the finished wrapping be entirely covered by shaped part 1B; this cutting can be done in a number of different ways according to the invention (see for example FIGS. 4 and 5).

The aforementioned FIGS. 4 and 5 are drawings of two embodiments showing only flat sheets 1, in which the flat part 1A will be completely covered by opposite flat part 1B in the finished wrapping.

The embodiments described and shown obviously do not cover all the possible embodiments of the invention, whose scope can be extended to various forms and shapes.

These embodiments are not, however, restricting or limiting in comparison with other embodiments obtained according to the concepts defined in the attached claims.

We claim:

1. A wrapping made, as packaging (6) for a product, from one piece by punching out and folding a flat sheet (1) of packaging material, comprising:

a first flat backing part (1A) having a first buttonhole (5) and a window (4) which can allow the product contained in the packaging (6) to be seen, said first buttonhole (5) and said window (4) being formed in a same obverse face (6A) of the packaging (6); and a second flat shaped part (1B) having a second buttonhole (5) that directly faces the first buttonhole (5) after folding of the second part (1B) along a plurality of premade fold lines (3), said second part (1B) being joined to the first part (1A) by a single one of the plurality of fold lines (3) so as to contain the product.

2. A wrapping according to claim 1, wherein:

said second part (1B) includes a plurality of surfaces (7), one of which serves as a reverse side (6B) of thee packaging (6) after the folding of the second part (1B) along the plurality of premade fold lines (3) so that, by printing, desired graphics can be obtained on said reverse side (6B).

3. A wrapping according to claim 2, wherein:

said flat sheet (1) of packaging material is composed of cardboard.

4. A wrapping according to claim 3, wherein;

said cardboard is obtained by recycling paper material.

* * * * *